US005705768A

United States Patent [19]

Ey

[11] Patent Number: 5,705,768

[45] Date of Patent: Jan. 6, 1998

[54] SHAPED CHARGES WITH PLASTIC LINER, CONCAVE RECESS AND DETONATOR MEANS

[75] Inventor: Anthony Leonard Ey, North Sydney, Australia

[73] Assignee: Dyno Nobel Asia Pacific Limited, North Sydney, Australia

[21] Appl. No.: 587,042

[22] Filed: Jan. 16, 1996

Related U.S. Application Data

[63] Continuation of Ser. No. 169,330, Dec. 17, 1993, abandoned.

[30] Foreign Application Priority Data

Dec. 24, 1992 [AU] Australia ..... PL6588

[51] Int. Cl.[6] ..... F42B 1/02

[52] U.S. Cl. ..... 102/307; 102/312; 102/313; 102/275.5; 102/275.7

[58] Field of Search ..... 102/307, 312, 102/313, 275.5, 275.7

[56] References Cited

U.S. PATENT DOCUMENTS

| | | | |
|---|---|---|---|
| 2,797,892 | 7/1957 | Ryan | 102/307 |
| 4,160,412 | 7/1979 | Snyer et al. | 102/307 X |
| 4,342,261 | 8/1982 | Majerus | 102/307 |
| 4,510,870 | 4/1985 | Walters | 102/307 |
| 4,759,886 | 7/1988 | Daugherity | 102/307 X |
| 4,858,531 | 8/1989 | Lindstadt et al. | 102/307 |
| 4,860,654 | 8/1989 | Chawla et al. | 102/307 X |
| 4,862,804 | 9/1989 | Chawla et al. | 102/307 X |
| 4,951,572 | 8/1990 | Bocker et al. | 102/307 X |
| 5,090,324 | 2/1992 | Bocker et al. | 102/307 |
| 5,204,493 | 4/1993 | Christmann et al. | 102/307 |
| 5,415,101 | 5/1995 | Brinkmann | 102/307 |

OTHER PUBLICATIONS

U.S. S.I.R. #H 866 published Jan. 1, 1991.

*Primary Examiner*—Peter A. Nelson

*Attorney, Agent, or Firm*—Abelman, Frayne & Schwab

[57] ABSTRACT

A shaped charge is provided which includes an elongate container or housing having a concave recess in an upper end thereof. Explosive is located or provided within the container and at least below the concave recess. Detonator means are provided within the container at or adjacent a lower end thereof and spaced apart from and below the concave recess and explosive located therebelow.

8 Claims, 4 Drawing Sheets

SHAPED CHARGES WITH PLASTIC LINER, CONCAVE RECESS AND DETONATOR MEANS

Figure 1:
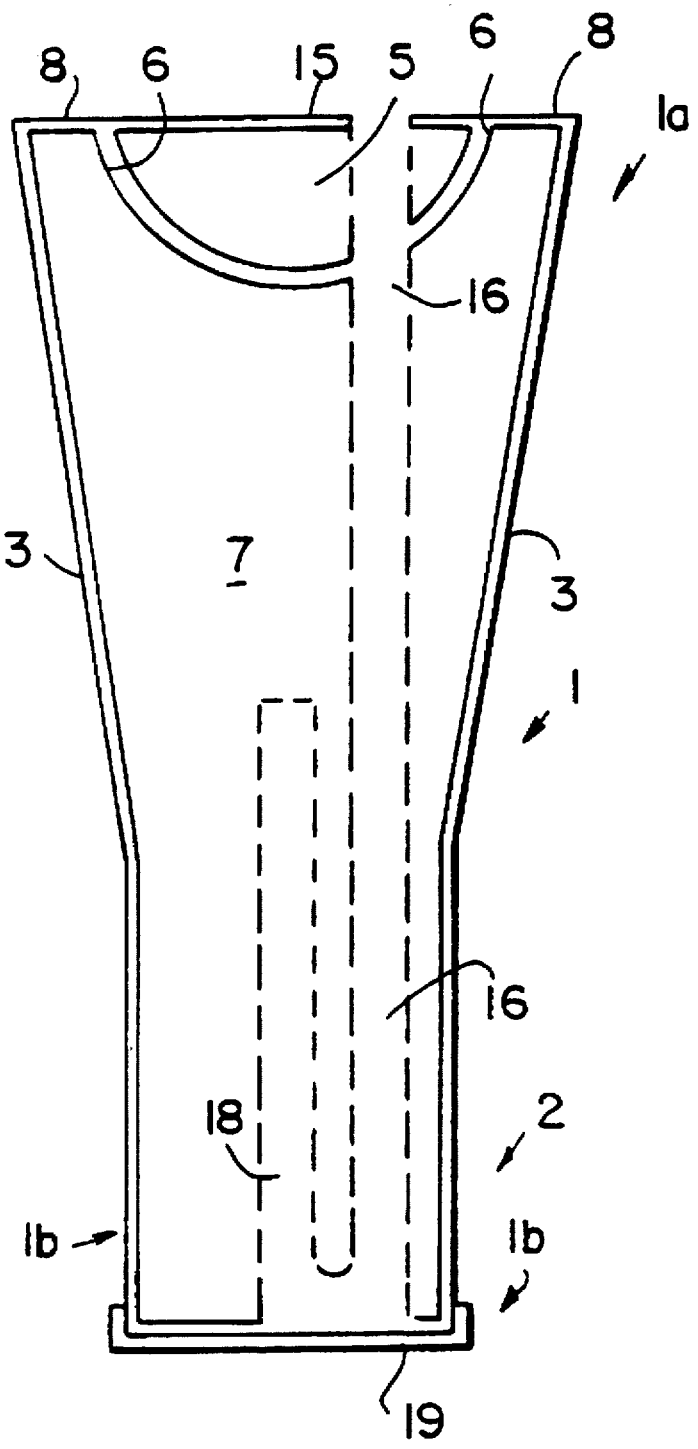

This application is a Continuation application under 37 C.F.R. 1.62 of prior application Ser. No. 08/169,330, filed on Dec. 17, 1993, and now abandoned.

THIS INVENTION relates to shaped charges and to the use of shaped charges in explosive blasting and in particular to explosive blasting in the mining industry.

Shaped charges are well known and usually include an outer housing or container, having an inner liner located therewithin. Known shaped charges include outer housings or containers of varying shapes, which have an inner liner located within the container. Explosives are usually placed within the container in a space not occupied by the liner. In known shaped charges, the containers or housings are usually of an elongate cylindrical shape, although other shapes are known. Liners formed of varying shapes are also known, being for example of a conical shape or hemispherical shape. A liner providing a cavity at one end of the housing or container is therefore known. Explosive material is usually placed within the container in a space or area not occupied by the liner. Known shaped charges also include detonator means within the housing or container, the detonator means usually being located within the container, substantially axially opposite to the liner. For example, where a liner is of a conical configuration, detonator means are usually provided axially opposite to the apex of such a conical liner. Where a liner is of a generally hemispherical configuration, the detonator is usually located at a point at or adjacent an end away from the liner, substantially axially opposite a point of greatest height of such a hemispherical liner.

Known shaped charges, including inter alia those referred to above, operate to provide a detonation wave or high velocity jet after detonation. By way of example, shaped charges using a conical liner have in particular been used in the field of military explosives. For example, in anti-tank or anti-aircraft shells.

Shaped charges have also been known and used in the mining industry, where explosives may be used for example to remove overburden in open cut mining or in other mining, so as to expose mineral strata or stratum; such as for example a coal seam or coal seams.

In the mining industry, explosives may be placed in one or more bore holes drilled through the overburden at spaced intervals, the bore holes extending through the overburden to approximately that position where mineral strata or stratum is/are located. Boosters, such as for example, cylindrical shapes of high velocity explosive, are then placed within one or more bore holes and a detonation fuse extends up to the top of each bore hole, wherein a detonation fuse may be connected to appropriate detonation means. This may be electrical or non-electrical as may be required.

When boosters such as those referred to above have been used in mining applications, there have been substantial disadvantages in such use, because on detonation, while part of an overburden may be removed, substantial damage has often occurred to the mineral strata or stratum. For example, providing deep craters in such mineral strata or stratum and in some cases rendering the mineral uncoverable or unusable. Essentially, this occurs because the shaped charges used up until this time, or boosters used up until this time have not provided efficient energy utilisation generated by the explosion of the shaped charge.

In many cases, the use of conventional shaped charges using conical liners, produces a very narrow energy wave, essentially in the form of a narrow lance, which is ineffective for appropriate or satisfactory mining applications. In the mining industry, the use of charges having substantially hemispherical liners has been such that the hemispherical liners have essentially been located so as to face or extend downwardly, within bore holes, and towards the mineral strata or stratum. Thus, on detonation, while the resultant explosion has, to an extend, removed overburden, substantial damage has also occurred to the mineral strata or stratum therebelow, and in some cases this has resulted in deep craters being formed in the mineral strata or stratum so that in some cases, the mineral is unrecoverable and unusable.

In U.S. patent specification No. 4,938,143, a booster is disclosed for use in the mining industry, and in applications as referred to above. However, the arrangement disclosed in U.S. patent specification No. 4,938,143 suffers from a fundamental deficiency in that it is unable to direct available energy where it is most needed. That is, directionally up into the explosives column so as to remove overburden, and not downward into the mineral strata or stratum, where there is a risk of damage to minerals (such as coal). The arrangements disclosed to U.S. patent specification No. 4,938,143, also fail to adequately utilise the energy to achieve the desired results.

It is therefore an object of at least one aspect of the present invention to go at least some way towards addressing the problems and disadvantages outlined above.

It is also an object of the present invention to provide a straightforward and efficient shaped charge for use in the explosives industry.

Other objects of this invention will become apparent from the following description.

According to one aspect of this invention, there is provided a shaped charge for use in blasting, including an elongate container or housing having a substantially concave recess in an upper end thereof; explosive being located and provided within said container and at least below said concave recess; detonator means being provided within said container, at or adjacent a lower end thereof and spaced apart from and below said concave recess.

According to a further aspect of this invention, there is provided a method of blasting to remove or diminish overburden for mineral strata or stratum, including:

(a) forming one or more bore holes in said overburden, (b) placing one or more shaped charges together with explosive within said one or more bore holes, wherein said shaped charges include an elongate container or housing having a concave recess in an upper end thereof with explosive being located within each container and at least below each concave recess; and wherein detonator means are provided within each container spaced apart from and below each concave recess; and (c) detonating said one or more charges such that the resultant energy is directed into said bore hole and substantially upwardly and outwardly thereof, so as to substantially remove or diminish said overburden.

This invention will now be described by way of example only and with reference to the accompanying drawings, wherein:

FIG. 1: is a sectional side view of a shaped charge according to one form of the present invention.

Figure 2:
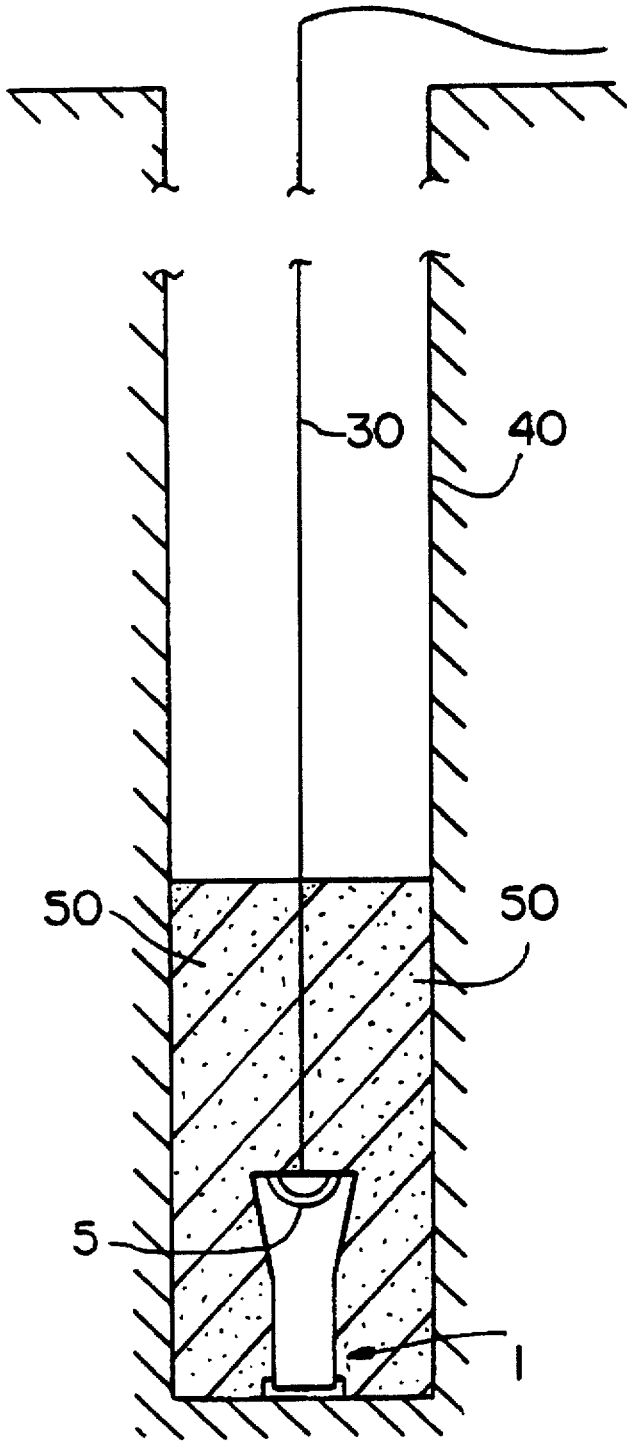

FIG. 2: is a view of a bore hole locating a shaped charge according to one form of the present invention.

Figure 3:
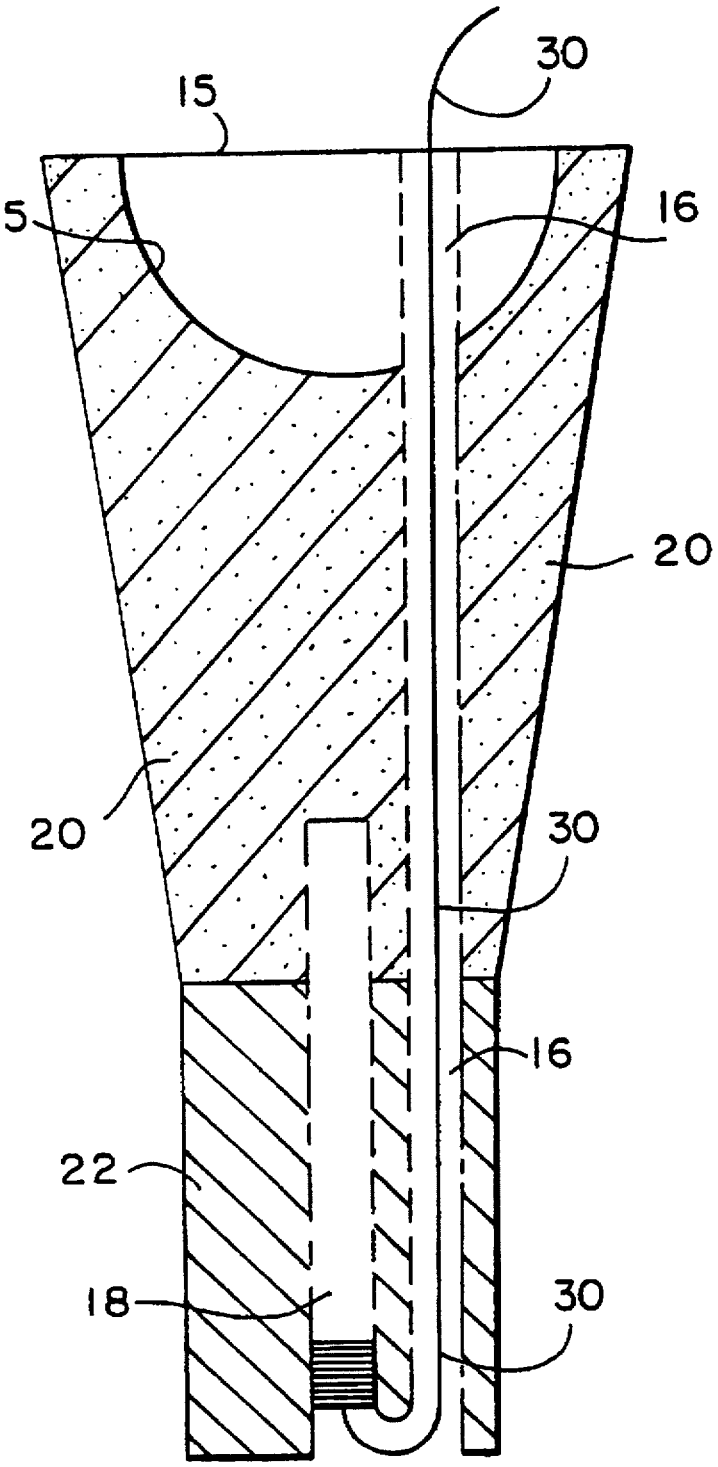

FIG. 3: is a further sectional view of a shaped charge according to a further form of the present invention.

Figure 4:
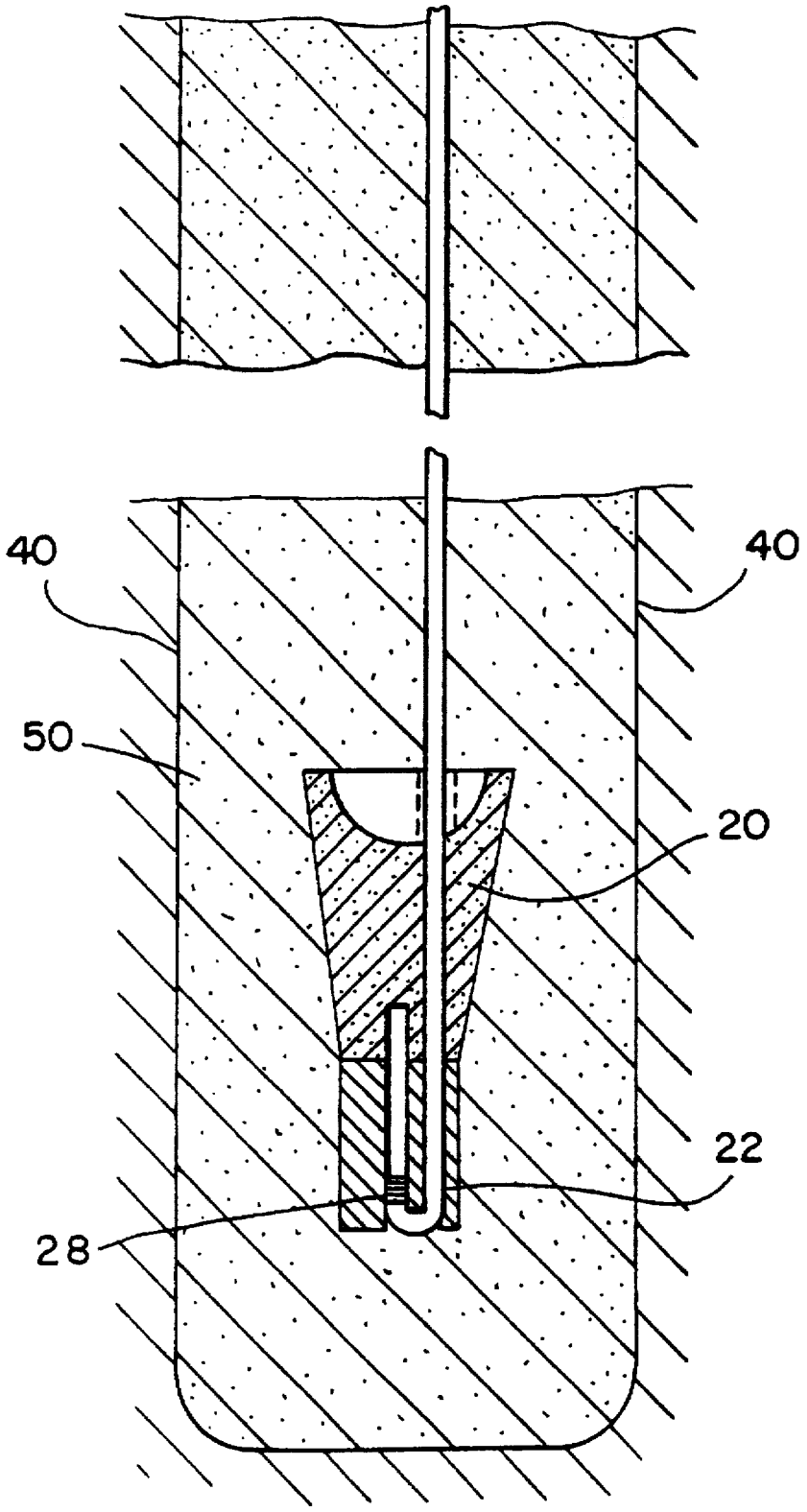

FIG. 4: is a further view of a bore hole locating a shaped charge according to one form of the present invention.

It should be appreciated that this invention is described by way of example only and that modifications and improvements may be made to the invention without departing from the scope thereof as defined by the appended claims. The present invention sets out to provide a straightforward and efficient shaped charge and a method of using shaped charges (particularly in the mining industry), which goes some way towards addressing the problems associated with the use of shaped charges up until this time. In particular, the present invention sets out to address the problem that certain shaped charges have up until this time resulted in either a very localised upward narrow energy wave, which has been ineffective in satisfactorily removing overburden, and/or alternatively have been so constructed and located in use, as to inadequately direct the energy where it is required. In such situations, energy has often been directed downwardly into the bore hole, so as to adversely affect the mineral strata or stratum, rather than being directed essentially upwardly, so as to remove or diminish the overburden in a satisfactory manner.

The shaped charge 1 of the present invention is preferably in the form of a container or housing of an appropriate water impervious material such as a plastics material, which can be formed by any appropriate means such as for example injection moulding or compression moulding. The container 1 can have any appropriate shape and can be of a cylindrical shape, frusto-conical shape or a combination of cylindrical and frusto-conical shape.

In the form of the invention shown by way of example only in the accompanying drawings, the shaped charge 1 has an essentially lower cylindrical body portion 2, the sides of which splay outwardly into angled sides 3, so that the container has an essentially combined cylindrical and frusto-conical shape. This is however by way of example only and other shapes can be used to advantage.

The container 1 of the present invention has a substantially hollow body 7 forming an explosives receptacle, and is provided with a shaped liner or recess 5 at an upper end 1*a* thereof, the recess 5 being substantially concave in formation and extending down into the body 7 of the container 1, as shown in the accompanying drawings. The outer sides 6 of the concave recessed portion are spaced inwardly from the outer upper side walls 3 of the container 1, by side stops or flanges 8, and explosive matter is inserted into the container 1 so as to be positioned at least below and preferably below and about the concave recess 5 at the upper end 1*a* of the container 1. It is important that the explosive composition 20 (see FIGS. 3 and 4) be at least below the concave recess 5, although in the preferred form of the invention, the explosive composition 20 is inserted into the container 1 so as to extend below and about the concave recess 5 in the upper end 1*a* of the container 1. The container 1 is preferably formed with an upper sealing wall 15 so as to hold the explosive within the container and is also provided with a lower base plate or lid 19, which seals and closes the container 1 in an appropriate manner. That is by bonding, clipping, friction fit or the like.

The container 1 is preferably provided with an elongate conduit 16 which runs from the upper end 1*a* of the container 1, through the sealing wall 15, through the wall of the concave recess 5 and down through the body 7 of the container 1, wherein towards the lower end 1*b* of the container 1, it extends into an upwardly extending (and substantially parallel but spaced apart) further recess 18 in the form of a detonator cavity 18. The conduit 16 and detonator cavity 18 are preferably integrally formed one with the other and lead into each other.

In use, and as shown in the accompanying drawings, a detonator 28 is located within the detonator cavity 18 and fuse means 30 connected thereto is fed from the detonator 28 through the lower part of the detonator cavity 18 and up through the conduit 16 so as to exit from the upper end thereof, through the sealing wall 15. The detonator 28 and fuse 30 are able to be placed in position by removal of the lid 19 which can be removably or sealably attached to the bottom of the container 1 and which also allows for the location of explosive composition 20 within the body of the container 1, so that the explosive is at the very least located below and preferably below and about the sides of the concave recess 5, the concavity of which extends upwardly from the upper end 1*a* of the container 1.

As shown by way of example only in the accompanying drawings, and more particularly in FIGS. 3 and 4 thereof, explosive material 20 (such as for example a cast explosive or any other appropriate explosive), is inserted into the container body 1 so as to extend about the concave recess 5 and at least below the concave recess 5, the explosive 20 filling the container 1 or at least partially filling the container, while the remainder of the container may be filled with some other appropriate insert filler 22. The combination of cast 20 explosive and inert filler 22 are shown by way of example only in FIGS. 3 and 4 of the accompanying drawings. If desired, the container 1 can be completely filled or only partially filled with explosive 20.

In use, the shaped charge of the present invention has the concave recess 5 provided in the upper end 1*a* of the container 1, so that the concavity faces upwardly. The charge or charges is/are located within one or more bore holes 40, such that the concave recess 5 faces upwardly, and the upwardly facing concave recess causes a substantial amount of the energy from the charge (when detonated), to extend up the bore hole 40 so as to remove or diminish the overburden, while minimising and to a substantial extent avoiding unsatisfactory down blasting or reverse blasting which has happened up until this time and which has resulted in damage to the mineral strata or stratum. The use of the upwardly extending concave recess 5, at the upper end 1*a* of the container 1, and the location of explosive 20 below and in one form of the invention partially about the recess 5, causes the energy following detonation, to be sufficiently distributed outwardly and upwardly through the bore hole 40. This addresses the problems that have been occasioned with shaped charges up until this time.

In use, one or more shaped charges 1 are lowered into a bore hole 40 by a fuse 30, which is of such a length as to enable the shaped charge 1 to be adequately lowered into one or more bore holes 40 so as to be located in a predetermined or desired position within the bore hole. For example, at or adjacent the lower end of a bore hole. The location of the fuse 30 within the shaped charge, by being attached to the detonator 28 located within the detonator cavity 18, allows for a fuse 30 of sufficient length to pass the shaped charge into the bore hole to the desired position, while the fuse is thereafter secured at the upper end of the bore hole, so as to be attached to appropriate actuating or blasting means. Appropriate explosive 50 (see FIG. 2 of the drawings), such as for example ANFO explosive or the like is pumped into the bore hole to a desired level such as shown for example in FIG. 2 of the accompanying drawings. Further explosive charges (not shown) may be loaded at higher levels in a bore hole 40, should this be desired.

In so far as the invention refers to the use of fuses, it should be appreciated that any appropriate fuse may be used, such as for example, detonation cord, or NONEL, or other known fuses or detonation cords.

Any appropriate explosive can be utilised in connection with the shaped charges of the present invention but include, by way of example, cast explosives such as those based on oxidising salts such as ammonium nitrate and calcium nitrate. Pentaerythritol tetranitrate (PETN), cyclotrimethylene trinitamine (RDX), trinitro phenyl methyl nitramine (TERYL) These are however by way of example only, and any appropriate explosives compositions can be used to advantage.

On substantial advantage of the present invention, in using the shaped charge having a concave recess in the upper and thereof, is that the detonation of the charge within a bore hole, substantially increases the directional effect of the explosion, which takes advantage of the focusing effect of the hollow charge principle, or the well known "Munroe Effect". The broad focused explosive front produced by the present invention, produces a maximum damage to the overburden while leaving the mineral strata or stratum essentially and effectively undamaged. On the other hand, and as referred to hereinbefore, when conventional known charges are used, mineral stratum is significantly damaged; in some case resulting in considerable mineral low. The invention therefore has substantial advantages, in that it provides a substantially more efficient use of the explosive force and also reduces the amount of damage to strata, this being particularly advantageous from a cost saving point of view.

By way of example, testing was carried out on a shaped charge substantially as shown in FIG. 1 of the accompanying drawings. Testing was also carried out on a normal booster charge. The normal booster charge was placed on a 2.5 cm thick sheet of steel. It was then detonated, and on explosion, massive damage was done to the sheet of metal. This was because essentially the charge was caused to move downwardly through the lower end of the container, and thus affected the metal sheet (as it would affect lower mineral strata or stratum). The damage covered an area greater than the cross-sectional area of the charge before detonation. In comparison, a shaped charge substantially as shown in FIG. 1 of the accompanying drawings, and as described and claimed in the present application, was also placed on a sheet of metal being 2.5 cm thick. The charge was first positioned so that the explosive force was directed downwardly towards the sheet of steel. In other words, the container 1 was placed upside down with the concave recess 5 extending downwardly or facing downwardly over the sheet of steel. On detonation, a hole was caused to be punched through the steel, the hole having a cross-section similar to that of the charge.

A further test was then carried out on a shaped charge according to the present invention, and as described and claimed herein. The shaped charge was placed on a 2.5 cm thick sheet of steel, with the concave recess 5 facing upwardly. On detonation, the explosive force was observed as being directed upwardly and away from the steel sheet. On inspection following explosion, it was found that there was no damage to the steel sheet.

In experimentation in mining situations, it has been found that the use of the shaped charge according to the present invention, results in minimal if any damage to lower strata or stratum, while explosion of the charges results in effective damage to the overburden, as is required.

It should be appreciated that in use, a plurality of bore holes 10 may be formed in an overburden, so as to remove overburden from a mineral stratum or strata. It should be appreciated however that while the invention can be used with a plurality of bore holes, it can also be used with a single bore hole.

It should be appreciated that the invention has been described by way of example only and that modifications and improvements may be made to the invention without departing from the scope thereof as defined by the appended claims.

I claim:

1. A shaped charge for use in blasting, whereby the charge when detonated releases energy focussed broadly upwardly of the charge, said charge including an elongate container having a substantially transverse base closure at a lower end and a plastics liner in an upper end thereof, said plastics liner spaced inwardly from said container and comprising an upwardly facing generally concave recess which is sealably closed, detonator means being provided on a longitudinal axis of the container within said container and spaced apart from said concave recess; and explosive being provided within said container in a space not occupied by the liner and extending about and below said recess, said explosive regularly decreasing in radial thickness as the explosive extends away from the longitudinal axis of the container towards a peripheral edge of the liner and being thinnest adjacent the peripheral edge of the recess.

2. A shaped charge as claimed in claim 1 wherein an elongate fuse conduit extends from the upper end of said container through said container terminating in an upwardly extending detonator cavity adapted to locate the detonator means at or adjacent the lower end of said container; the base closure covering and sealing the lower end of said container when said detonator means is in place.

3. A shaped charge as claimed in claim 1 wherein fuse means are provided and connected to said detonator means, such as to extend from said detonator means through a lower portion of said detonator cavity and up through said fuse conduit to exit from the upper end of said container; said fuse being of a predetermined or desired length to allow for location of said shaped charge within a bore hole.

4. A shaped charge as claimed in claim 1 wherein said container is filled with explosive material.

5. A shaped charge as claimed in claim 1 wherein said container is filled with explosive material and filler.

6. A shaped charge as claimed in claim 1 wherein the concave recess defines a spherical cap.

7. A shaped charge as claimed in claim 2 wherein the concave recess defines a spherical cap.

8. A method of blasting to remove or diminish overburden for mineral strata or stratum, including:

(a) forming one or more bore holes in said overburden;

(b) placing a plurality of shaped charges together with explosive within said one or more bore holes.

(c) said shaped charges including an elongate container having a substantially transverse base closure at a lower end and a plastics liner in an upper end thereof, said plastics liner spaced inwardly from said container and comprising an upwardly facing generally concave recess which is sealably closed, detonator means being provided on a longitudinal axis of the container within said container and spaced apart from said concave recess; and explosive being provided within said container in a space not occupied by the liner and extending about and below said recess, said explosive regularly decreasing in radial thickness as the explosive extends away from the longitudinal axis of the container towards a peripheral edge of the liner and being thinnest adjacent the peripheral edge of the recess.

(d) wherein said plurality of shaped charges are located in said one or more bore holes, one above the other; and (e) detonating said charges such that energy released from each charge is focussed broadly upwardly within said bore hole, so as to substantially remove or diminish overburden thereabouts.

* * * * *